US007140456B2

(12) United States Patent
Maki

(10) Patent No.: US 7,140,456 B2
(45) Date of Patent: Nov. 28, 2006

(54) EASY HOLD POWER AUGER

(76) Inventor: Brian Maki, P.O. Box 6, Nolalu, Ontario (CA) P0T 2K0

( * ) Notice: Subject to any disclaimer, the term of this patent is extended or adjusted under 35 U.S.C. 154(b) by 260 days.

(21) Appl. No.: 10/810,327

(22) Filed: Mar. 26, 2004

(65) Prior Publication Data

US 2005/0000736 A1 Jan. 6, 2005

(30) Foreign Application Priority Data

Jul. 4, 2003 (CA) ..... 2434378

(51) Int. Cl.
*E21B 10/44* (2006.01)
*E21B 10/40* (2006.01)
*F16H 37/06* (2006.01)

(52) U.S. Cl. ..... 175/394; 175/202; 175/323; 175/388; 408/37; 408/124; 475/332

(58) Field of Classification Search ..... 175/323, 175/202, 334, 377, 386, 388, 394; 408/36, 408/124; 475/248, 332
See application file for complete search history.

(56) References Cited

U.S. PATENT DOCUMENTS 2,148,313 A * 2/1939 Williams ..... 475/332
2,250,671 A * 7/1941 Joy ..... 175/173
2,261,104 A * 10/1941 Birkigt ..... 475/332
3,572,449 A * 3/1971 Brocas et al. ..... 175/57
4,819,744 A * 4/1989 Caswell ..... 175/18
4,947,943 A * 8/1990 Litwak ..... 175/18
5,038,870 A * 8/1991 Kuronen ..... 175/18

* cited by examiner

*Primary Examiner*—David Bagnell
*Assistant Examiner*—Robert Fuller
(74) *Attorney, Agent, or Firm*—Adrian D. Battison; Michael R. Williams; Ryan W. Dupuis

(57) ABSTRACT

A cutting auger has a main auger blade and a front subsidiary coaxial blade each having a drive core and a helical auger flight carried on the drive core for rotation about a longitudinal axis of the drive core with a cutting edge at an axial end face of the auger flight, such that when rotated the cutting edge cuts a hole equal in diameter to the helical flight and the helical flight carries the cut material away from the cutting edge. The second auger blade having a smaller diameter than the first, is shorter than the first and is arranged with the helical turns thereof in opposed angular direction. A planetary drive system is arranged to rotate the first and second cutting augers in opposed direction with the first driven at a slower angular velocity than the second so as to balance the torque.

13 Claims, 4 Drawing Sheets

EASY HOLD POWER AUGER

This invention relates to a cutting auger which is designed to reduce the torque transferred from the auger to the support, generally the hands and arms of the user, to allow easier handling by the user.

BACKGROUND OF THE INVENTION

Power augers are made by many companies and come in many sizes usually 8 inch diameter is common. All the augers that I have seen use the same principal with the whole blade rotating the same way, cutting the hole with one pair of blades. Most augers are designed with a centrifugal clutch with a small gear mounted to the centre of the output side. This turns a bigger gear giving a fairly high gear reduction. This bigger gear is attached to the auger shaft.

SUMMARY OF THE INVENTION

It is one object of the invention to provide a cutting auger which provides the possibility of a reduction in torque allowing it to be manually held more easily.

According to one aspect of the invention there is provided a cutting auger comprising:

a first auger blade having a first drive core and a first helical auger flight carried on the first drive core for rotation about a longitudinal axis of the first drive core with a cutting edge at an axial end face of the first auger flight such that when rotated the cutting edge cuts a hole approximately equal in diameter to the helical flight and the helical flight carries the cut material away from the cutting edge;

a second auger blade having a second drive core and a second helical auger flight carried on the second drive core for rotation about a longitudinal axis of the second drive core with a cutting edge at an axial end face of the second auger flight such that when rotated the cutting edge cuts a hole approximately equal in diameter to the helical flight and the helical flight carries the cut material away from the cutting edge;

the second auger blade being coaxial with the first and arranged with the cutting edge thereof axially in advance of the first;

the second auger blade having a smaller diameter than the first;

the first and second helical auger flights being arranged with the helical turns thereof in opposed angular direction;

and a drive assembly arranged to rotate the first and second cutting augers in opposed direction with the first driven at a slower angular velocity than the second.

In most cases the hole cut by the blade is equal to the diameter of the auger flight to best carry away the cut materials, but this is not essential and the hole may be slightly larger than the diameter provide the auger is of sufficient diameter to effectively remove the material.

Preferably the drive assembly is mounted at a rear or upper end of the first cutting auger.

Preferably the drive assembly is mounted at a housing having at least one handle for manually holding the cutting auger for preventing rotation of the housing and handle about the axis.

Preferably the drive assembly includes a motor. However as an alternative, the drive assembly may include a manually operable crank which may have a ratchet to allow rotation from a preferred location for applying maximum manual force.

Preferably the second cutting auger has a rear end at or adjacent the cutting edge of the first auger so that it is immediately in front of the first or main auger.

Preferably the second cutting auger is shorter than the first cutting auger.

Preferably the drive assembly includes a planetary gear set. In this arrangement, the second drive core may be driven by the sun of the planetary gear set and the first drive core is driven by the ring of the planetary gear set.

In this arrangement preferably the drive assembly includes two planetary gear sets arranged axially spaced where the second cutting auger has the second drive core connected to the ring of the first planetary gear set, and wherein the sun of the first planetary gear set is driven, wherein the sun of the second planetary gear set is driven commonly with the second drive core and wherein the first drive core is driven from the ring of the second gear set.

Preferably the first cutting auger is driven at a rate of the order 3 times less than the second cutting auger, although this ratio may vary widely depending upon diameter of the augers and other factors.

Preferably the ratio of the diameters of the cutting augers is arranged relative to the difference in speed thereof such that the torque is substantially balanced when both cutting augers are cutting.

The device as described herein uses two cutting blades turning in opposite directions to reduce the effort involved with holding a power auger while drilling through ice. The augers in use at this time need large handles to hold the motor section of power auger from rotating. If the proper footing cannot be found say on glare ice this can be difficult and if it gets away, can be somewhat dangerous. The device as described herein looks the same as an ordinary power auger but for one major difference. The auger has two cutting blades turning in opposite directions eliminating most of the effort involved with holding it from rotating.

With the effort involved with holding an auger from spinning reduced, the handles can be made very small reducing the size of the unit considerably. This auger is much safer for small people to use such as children and small women. The drive power requirements may also be reduced as the smaller auger section will rotate fairly quickly and the larger diameter section will turn slower with more torque. If the overall diameter of the auger is 10 inches the smaller section will be cutting 6 inches so two 2 inch blades can cut the outer 4 inches. With these cutting in opposite directions the effort to hold it, that is the external torque applied by the user, will be greatly reduced.

The device as described herein uses two sets of planetary gear sets. The output side of the clutch rotates the sun gear that turns the small auger planetary gears about ⅓ engine speed. The small auger shaft rotates the sun gear that drives the large auger ring gear through the planetaries making it rotate in the opposite direction at about ⅓ the speed of the small auger. The small auger has a small diameter so the force required to turn it is much less. The larger diameter auger needs more power so it turns slower. If the power requirements are about the same for large auger to turn slowly as the small auger to turn quicker, the rotational torque will cancel each other out. This means the auger is easy to hold from rotating. In other words, the opposing torques on the inner and outer cores or shafts will be approximately equal and will approximately cancel each other out or at least provide a significant reduction in net torque applied by the user, thus eliminating or reducing the external force on the handle which is required to prevent the motor and housing from rotating. The total power from the motor may also be reduced. This may be because it is more effective to chip or shear ice from a small annular area than by cutting it from a flat surface.

Fisherman that do a lot of ice fishing and drill a lot of holes will find the effort greatly reduced so they can drill more holes with the same effort. The space to transport my auger is less due to the handles being much smaller. Smaller people that had difficulty holding the single blade augers will be able to use this auger with ease. If there is no snow to get traction such as in the spring once the ice lifts, sliding around the auger hole will not occur like while drilling with the single blade augers.

The use of planetary gear sets may be more expensive to build, but the life of the auger will be extended due to the gears lasting much longer, as opposed to conventional augers which can fail because of gears stripping. They also fit into a much smaller package. The gear sets to drive my auger could fit into a space 3 inch diameter times less than 1 inch high for each auger. The drawing I made for this auger shows the small auger cutting head attaching to the end of the shaft at the bottom of the big auger. The shaft could also thread into the sun gear below the clutch housing at the top so the augers could be removed completely making the motor section very small for transporting. The device as described herein can also use a hand auger using this blade configuration. With the rotational torque eliminated turning a handle from the side as shown could also be a possible.

While the use of planetary gear sets or set as in the embodiment described hereinafter is a particularly effective method of driving, there are many other standard power methods which could be used especially on other applications. These could include various gear-sets, chain and sprockets, pulleys, hydraulic motors, variable speed electric motors. Some of these may be more suited to other applications.

While the device has been particularly designed and is particularly suitable as an ice auger, the uses to which the device can be put are not so limited and may include drilling of many different types of materials such as soil.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
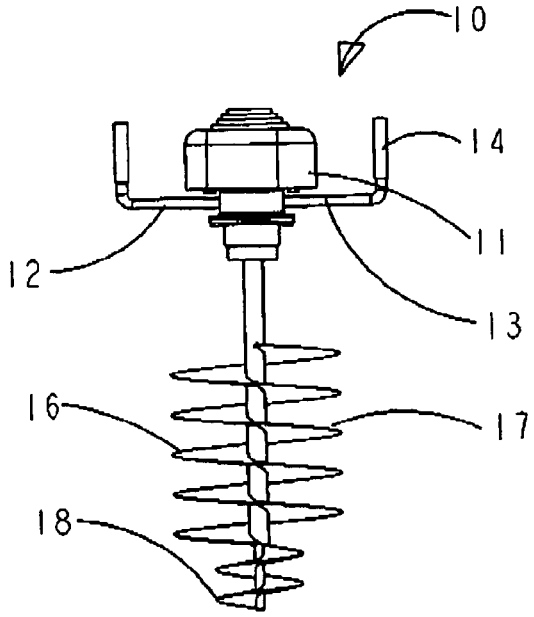
FIG. 1 is a side elevational view of an auger according to the present invention.
Figure 2:
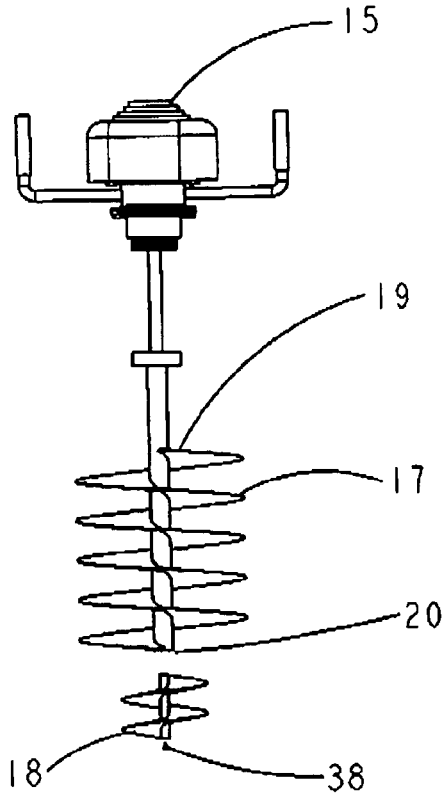
FIG. 2 is an exploded view of the auger of FIG. 1.
Figure 3:
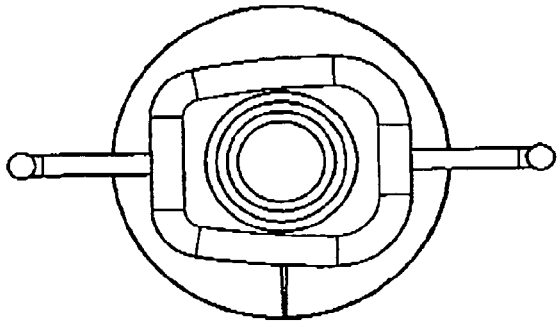
FIG. 3 is a top plan view of the auger of FIG. 1.

In FIGS. 1, 2 and 3 is shown a first embodiment of the auger which includes a main housing 10 which carries handles 11 and 12 so that the housing can be supported by one or more persons grasping the handles and holding the housing so that the auger is vertical for drilling vertically downwardly into suitable material. The handles include a pair of opposed arms 13 with upstanding handle elements 14 which can be grasped by the hands of the user.

A drive motor 15 is mounted on the top of the housing between the handles and provides power to the auger for driving the auger with the housing held stationary. The auger includes a downwardly depending auger assembly 16 having a first or main auger 17 and a subsidiary auger 18. The main auger 17 has a larger diameter extending from an upper end 19 to a lower end 20. The subsidiary auger 18 is of smaller diameter and is shorter and is located at the lower end 20 so as to extend downwardly therefrom. The flight of the main auger 17 is directed in one helical direction and the flight of the subsidiary auger at the bottom is directed in the opposite angular direction.

Figure 5:
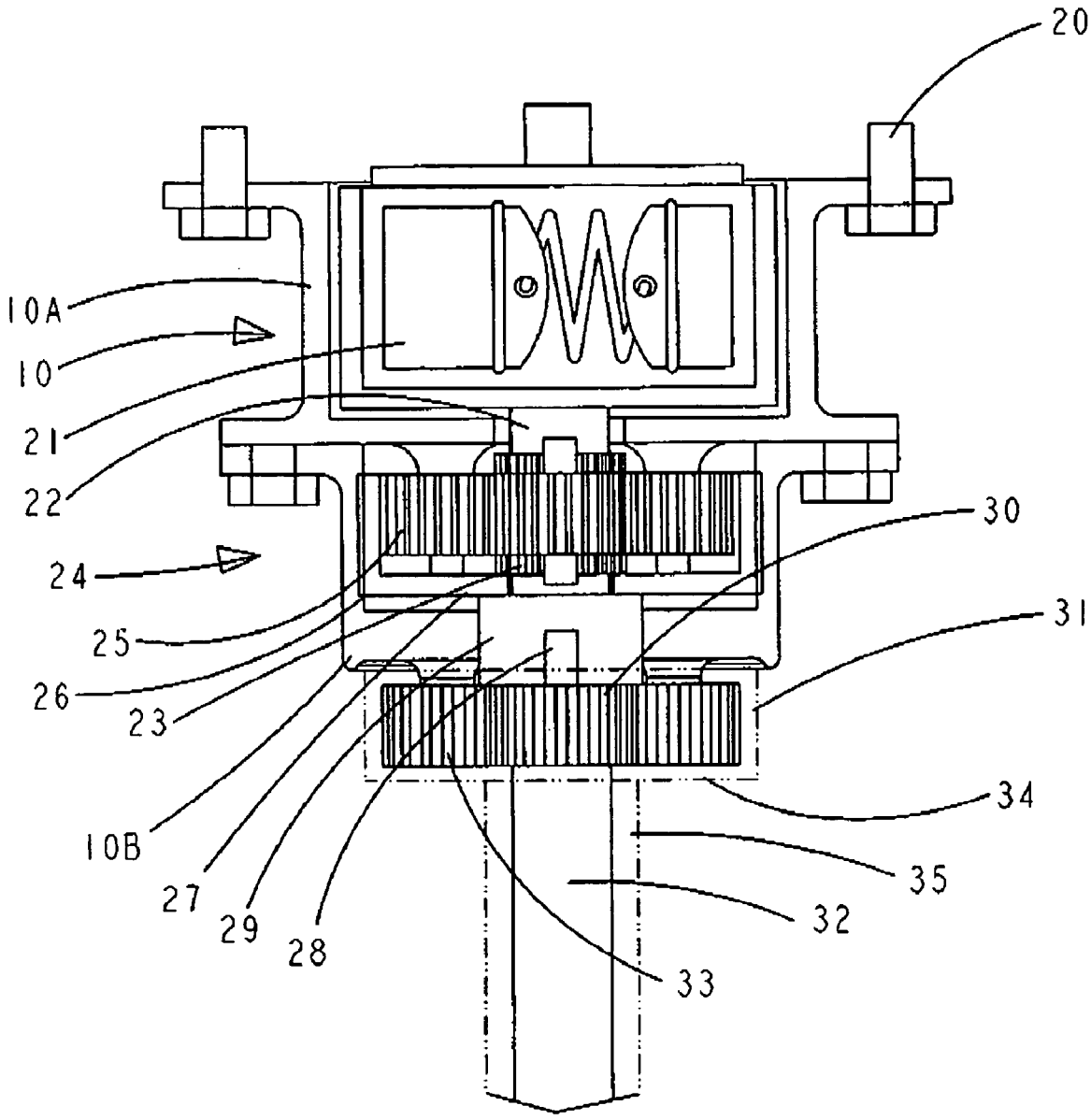
FIG. 5 is a vertical cross sectional view of the drive components for the auger.

Turning now to FIG. 5, the housing 10 is shown in more detail on which the motor is mounted by mounting bolts 20. The motor is shown removed for convenience of illustration. The motor drives a centrifugal clutch 21 within a first section 10A of the housing with an upper thrust bearing 22 located at the bottom of the first section 10A and holding the clutch in place. The centrifugal clutch drives a sun gear 23 of a first planetary set of gears 24 mounted within a second section 10B of the housing. The planet gears 25 of the first set 24 are mounted on the housing so as to drive the ring 26 at a reduced speed. The ring 26 sits on a lower thrust bearing 27. The ring 26 drives a shaft 28 which is threadably connected to a collar 29 on the bottom of the ring. The shaft 28 drives the sun 30 of the second set 31 of planetary gears and also drives an inner shaft 32 which is connected to the second or subsidiary auger flight at the bottom of the main auger flight. The second set 31 of planetary gears includes planets 33 carried in the housing section 10B and a ring 34 which is driven at a slower speed and in opposite direction to the sun 30 connected to the inner shaft 32. The ring 34 is connected to an outer drive core 35 which is co-axial to and surrounding the inner shaft 32 or inner core. Thus the core 32 and core 35 are driven in opposite directions with the outer core driven slower than the inner core. The main auger includes a flight attached to the outside surface of the outer core 35. The second auger flight 18 is attached to the lower end of the inner core by a locking screw 38.

Figure 6:
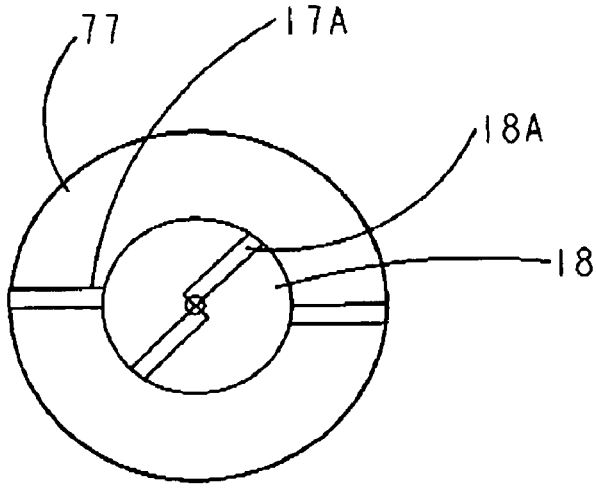
FIG. 6 is a bottom plan view of the auger.

As shown in FIG. 6 the lower end of the flight 17 has cutting blades 17A attached thereto and symmetrically the lower end of the flight 18 has blades 18A attached thereto. The upper end of the flight 18 butts against a bearing housing for the lower end of the flight 17.

In conventional manner the flight 17 has a short flute section and a slush flute section. The lower end of the secondary flight section has a central stabilizer point.

In operation the motor drives the centrifugal clutch and when driven at sufficient speed drives through the clutch into the drive mechanism including the upper and lower planetary gear sets. The gear sets are arranged so that the outer drive core 35 is driven at a slower speed than the inner drive core 32 and in opposite direction. Thus the subsidiary auger engages into the material to be cut such as ice and provides an initial cutting action with relatively low torque in view of the relatively small diameter of the subsidiary auger section. Once the subsidiary auger section is drilled through the material to the required depth, the bottom end of the main auger flight engages the top of the material and thus cuts out an annular portion of greater diameter than the portion already cut and rotates in opposite directions so that the torque is balanced between the two auger flight sections as they are cutting simultaneously into the material to be cut but in opposite directions. The relative diameters are arranged in relation to the relative speeds so that the torque is substantially balanced when both auger flights are cutting.

Figure 4:
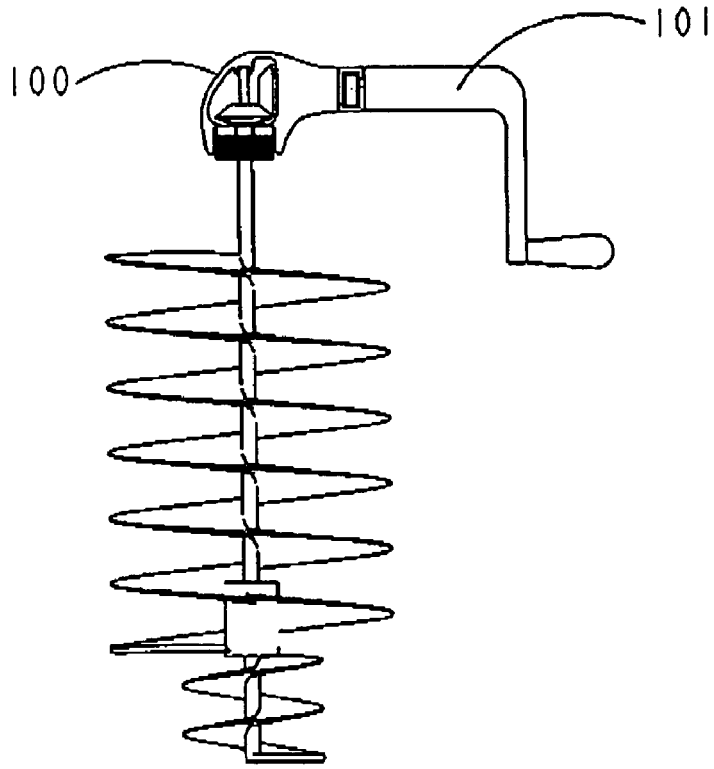
FIG. 4 is a side elevational view of the second embodiment which uses a manual crank rather than a motor.
Figure 7:
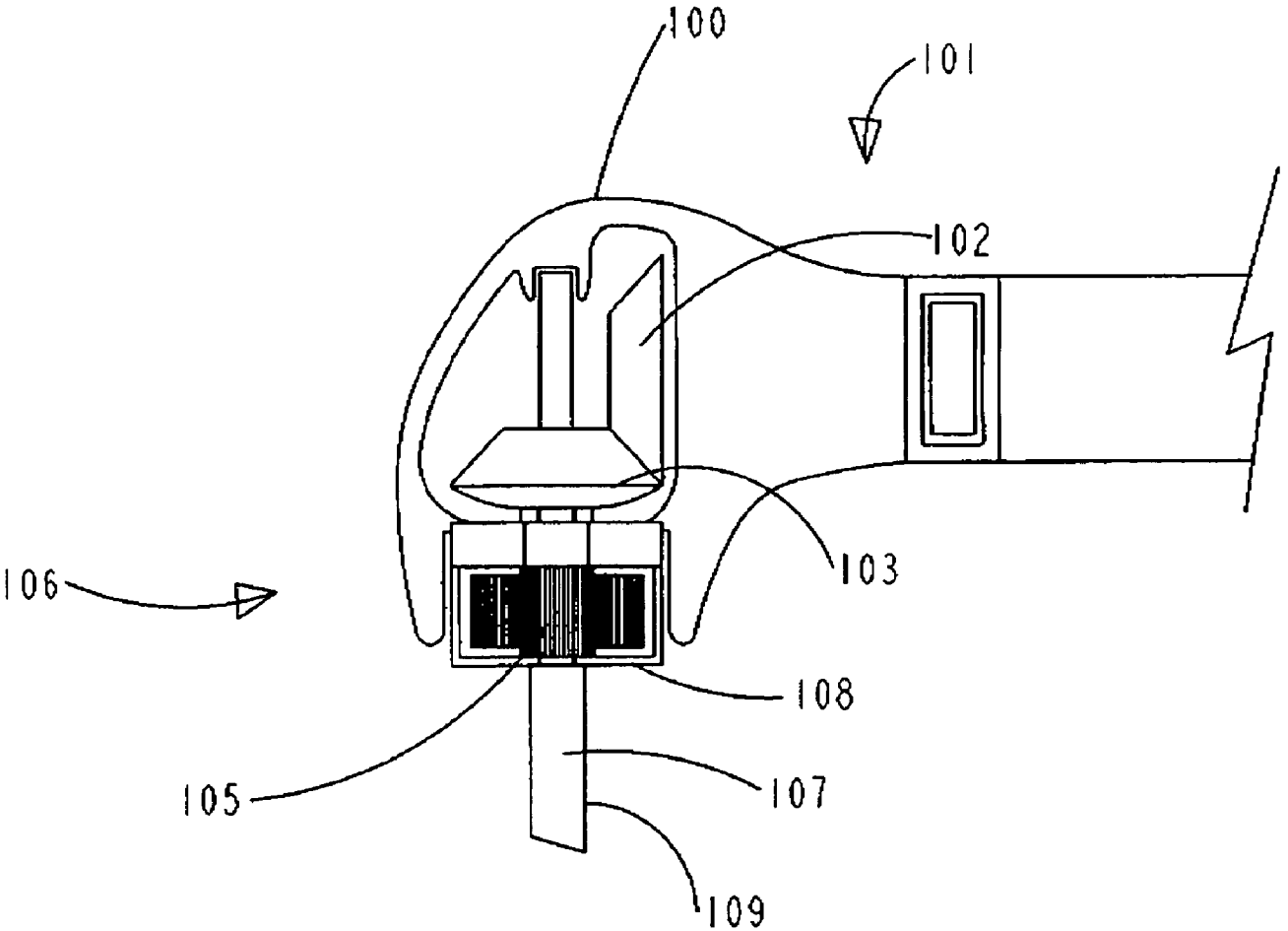
FIG. 7 is a vertical cross sectional view of the drive components of the auger of FIG. 4.

In FIG. 4 is shown an alternative arrangement with the drive arrangement therefore shown in FIG. 7. In this arrangement the housing is modified to form a housing 100 with instead of having a motor at the center it includes a crank at one side which can be manually operated. The handle or crank 101 drives through a ratchet which allows the handle to be located at a convenient angle for the operator in the event that the auger becomes jammed and requires rigorous force to restart the rotation. The handle 101 drives a bevel gear 102 which in turn is connected to a bevel gear 103 carried on a shaft 104. The shaft drives the sun gear 105 of the planetary set 106 and also drives the inner shaft 107. The ring 108 drives the outer core 109 so that the drive system provides drive for the primary and secondary auger flights as previously described.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A cutting auger comprising:

a first cutting device mounted on a first drive core for rotation about a longitudinal axis of the first drive core;

the first cutting device comprising a first helical flight coaxially surrounding the first drive core with a first cutting arrangement at an axial end of the first cutting device such that, when the first cutting device is rotated, the first cutting arrangement and the first helical flight rotate at a common first rate of rotation;

the first cutting arrangement having an outermost cutting point of its cutting action at a location which generates a cutting diameter of the first cutting device which is equal in diameter to an outer diameter of the first helical flight such that, when rotated, the first cutting element cuts a hole equal in diameter to an outer diameter of the first helical flight and the first helical flight carries the cut material away from the first cutting arrangement;

a second cutting device mounted on a second drive core for rotation about a longitudinal axis of the second drive core;

the second cutting device comprising a second helical flight coaxially surrounding the second drive core with a second cutting arrangement at an axial end of the second cutting device such that, when the second cutting device is rotated, the second cutting arrangement and the second helical flight rotate at a common second rate of rotation;

the second cutting arrangement having an outermost cutting point of its cutting action at a location which generates a cutting diameter of the second cutting device which is equal in diameter to an outer diameter of the second helical flight such that, when rotated, the second cutting element cuts a hole equal in diameter to an outer diameter of the second helical flight and the second helical flight carries the cut material away from the second cutting arrangement;

the second cutting device being coaxial with the first cutting device and arranged with the second cutting arrangement thereof axially in advance of the first cutting arrangement;

the first and second helical flights being arranged with the helical turns of the first helical flight in opposed angular direction to the helical turns of the second helical flight;

and a drive assembly arranged to rotate the first cutting device in opposed direction to that of the second cutting device;

the outermost cutting point of the second cutting arrangement defining the cutting diameter of the second cutting device which is smaller than the cutting diameter generated by the first cutting arrangement such that an outer annular portion of the first cutting arrangement of the first cutting device effects a cutting action to generate a hole greater in diameter than the second cutting arrangement;

the drive assembly being arranged to drive the first cutting device at a first speed and to drive the second cutting device at a second speed with the first and second speeds arranged such that torque generated by the cutting action of the first cutting device in one direction substantially balances torque generated by the cutting action of the second cutting device in the opposite direction.

2. The cutting auger according to claim 1 wherein the drive assembly is mounted at a rear end of the first cutting device.

3. The cutting auger according to claim 1 wherein the drive assembly is mounted at a housing having at least one handle for manually holding the drive assembly for preventing rotation of the drive assembly about the axis.

4. The cutting auger according to claim 1 wherein the drive assembly includes a motor.

5. The cutting auger according to claim 1 wherein the drive assembly includes a manually operable crank.

6. The cutting auger according to claim 5 wherein the crank includes a ratchet.

7. The cutting auger according to claim 1 wherein the second helical flight has a rear end at the first cutting arrangement.

8. The cutting auger according to claim 1 wherein the second helical flight is shorter than the first helical flight.

9. The cutting auger according to claim 1 wherein the drive assembly includes a planetary gear set.

10. The cutting auger according to claim 1 wherein the drive assembly includes two planetary gear sets arranged axially spaced.

11. The cutting auger according to claim 10 wherein the driving arrangement includes an input drive member, a first planetary gear set having a first sun and a first planet ring and a second planetary gear set having a second sun and a second planet ring, wherein the second drive core is connected to the first planet ring of the first planetary gear set, wherein the sun of the first planetary gear set is driven by the input drive member, wherein the second sun of the second planetary gear set is connected to the second drive core for common rotation therewith and wherein the first drive core is driven from the second planet ring of the second planetary gear set.

12. The cutting auger according to claim 1 wherein the first cutting device is driven at a rate of the order 3 times less than the second cutting device.

13. A cutting auger comprising:

a first cutting device mounted on a first drive core for rotation about a longitudinal axis of the first drive core;

the first cutting device comprising a first helical flight coaxially surrounding the first drive core with a first cutting arrangement at en axial end of the first cutting device such that, when the first cutting device is rotated, the first cutting arrangement and the first helical flight rotate at a common first rate of rotation;

the first cutting arrangement having an outermost cutting point of its cutting action at a location which generates a cutting diameter of the first cutting device which is equal in diameter to an outer diameter of the first helical flight such that, when rotated, the first cutting element cuts a hole equal in diameter to an outer diameter of the first helical flight and the first helical flight carries the cut material away from the first cutting arrangement;

a second cutting device mounted on a second drive core for rotation about a longitudinal axis of the second drive core;

the second cutting device comprising a second helical flight coaxially surrounding the second drive core with a second cutting arrangement at an axial end of the second cutting device such that, when the second cutting device is rotated, the second cutting arrangement and the second helical flight rotate at a common second rate of rotation;

the second cutting arrangement having an outermost cutting point of its cutting action at a location which generates a cutting diameter of the second cutting device which is equal in diameter to an outer diameter of the second helical flight such that, when rotated, the second cutting element cuts a hole equal in diameter to an outer diameter of the second helical flight and the second helical flight carries the cut material away from the second cutting arrangement;

the second cutting device being coaxial with the first cutting device and arranged with the second cutting arrangement thereof axially in advance of the first cutting arrangement;

the first and second helical flights being arranged with the helical turns of the first helical flight in opposed angular direction to the helical turns of the second helical flight;

and a drive assembly arranged to rotate the first cutting device in opposed direction to that of the second cutting device;

the outermost cutting point of the second cutting arrangement defining the cutting diameter of the second cutting device which is smaller than the cutting diameter generated by the first cutting arrangement such that an outer annular portion of the first cutting arrangement of the first cutting device effects a cutting action to generate a hole greater in diameter than the second cutting arrangement;

the drive assembly having a gear transmission providing a fixed speed ratio arranged to drive the first cutting device at a first speed and to drive the second cutting device at a second speed with the first and second speeds arranged such that torque generated by the cutting action of the first cutting device in one direction substantially balances torque generated by the cutting action of the second cutting device in the opposite direction.

* * * * *